United States Patent [19]

Morishita

[11] 4,255,935

[45] Mar. 17, 1981

[54] LIQUID ATOMIZING DEVICE

[75] Inventor: Teru Morishita, Shizuoka, Japan

[73] Assignee: Toyoto Jidosha Kogyo Kabushiki Kaisha, Toyota, Japan

[21] Appl. No.: 953,879

[22] Filed: Oct. 23, 1978

[30] Foreign Application Priority Data

Mar. 20, 1978 [JP] Japan ..... 53/32736

[51] Int. Cl.[3] ..... F02C 7/22

[52] U.S. Cl. ..... 60/745

[58] Field of Search ..... 60/39.74 S, 745; 261/88, 89

[56] References Cited

U.S. PATENT DOCUMENTS

| | | | |
|---|---|---|---|
| 2,705,401 | 4/1955 | Allen et al. | 60/39.74 S |
| 3,077,076 | 2/1963 | Williams et al. | 60/39.74 S |
| 3,102,393 | 9/1963 | Clare | 60/745 |

*Primary Examiner*—Robert E. Garrett

*Attorney, Agent, or Firm*—Stevens, Davis, Miller & Mosher

[57] ABSTRACT

A liquid atomizing device comprises a cylindrical body provided with an inner cylinder having a cylindrical inner peripheral surface and an outer cylinder secured to the front end of said inner cylinder and having a cylindrical inner peripheral surface concentric with the inner peripheral surface of the inner cylinder. The inner peripheral surface of the outer cylinder has a larger diameter than that of the inner cylinder. The device includes a nozzle injecting a liquid against the inner peripheral surface of the inner cylinder during rotation of both of said cylinders at a high speed. The injected liquid is centrifugally scattered in a thin layer on the inner peripheral surface of the inner cylinder and spouted from its front end against the inner peripheral surface of the outer cylinder in a spray of fine particles, and further spouted from the front edge of the entire periphery of the inner peripheral surface of the outer cylinder in a spray of still finer particles due to the larger centrifugal force thereof exerted by the rotation of the outer cylinder than by the inner cylinder.

5 Claims, 10 Drawing Figures

LIQUID ATOMIZING DEVICE

This invention relates to a device for atomizing a liquid, for example, a liquid fuel.

In the prior art of a device for atomizing a liquid, for example, a liquid fuel, a rotational liquid atomizing device is publicly well known. In the field of the rotational liquid atomizing device, there is a device to atomize a liquid using centrifugal force, in which the liquid is injected against a rotating disc from a nozzle and adheres to the disc to be centrifugally atomized. In this device, however, when the rotational speed of the disc is increased the liquid lashes against and is splashed by the disc without adhering thereto, consequently the liquid can not be atomized at all. In this device, effective atomization may be obtained when the peripheral speed of the disc against which the liquid strikes is below 10 m/sec at the liquid striking position, but when the peripheral speed of the disc becomes over 20 m/sec, it becomes impossible for a liquid to be atomized.

Another device is also known in this field, in which the fuel is supplied to a hollow space provided in a rotational shaft along the center axis thereof from an open end of the hollow space and injected from an injection port to be atomized by the centrifugal force. In this device, however, it is known that how the diameter of the injection port may be made small, the particle sizes of the atomized fuel particles can not be made sufficiently small, which is also clear from the results of the experiment below mentioned (FIG. 3).

A device is also known in which a swirl nozzle is provided to a rotational shaft to make the particle sizes of the fuel particles smaller. In such a device the swirl nozzle is secured to the rotational shaft and a very large centrifugal force is applied to the swirl nozzle in accordance with the rotation of the rotational shaft, so that the swirl nozzle is in peril of falling off from the rotational shaft unless it is firmly secured thereto.

Further, such two devices may only be applied when the fuel is supplied from an end into a hollow space formed within a rotational shaft along its center line and injected through a rotating nozzle and they can not be applied when the fuel is supplied through a fixed nozzle.

It is an object of this invention to provide a liquid atomizing device having a small size and a simple structure making use of the centrifugal force of a cylindrical body rotating at a high speed to create a spray of fine liquid particles of very small diameter uniformly distributed along the entire periphery of the cylindrical body.

It is another object of this invention to provide a liquid atomizing device which may easily be employed in a gas turbine operated by a liquid fuel and may also give to the gas turbine a high thermal efficiency and a uniform temperature distribution in a combustion chamber thereof without being influenced at all by high temperature.

The invention will now be described in further detail by way of example with reference to the accompanying drawings, in which.

Figure 2:
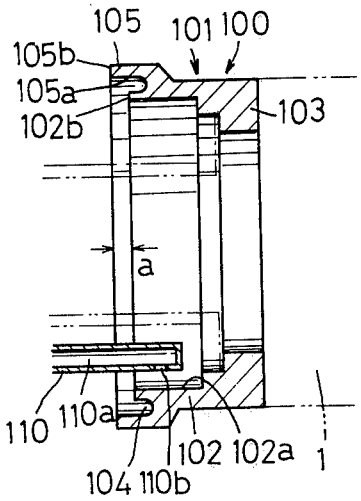
FIG. 2 is a longitudinal cross section of a first embodiment of this invention.

FIG. 2 shows a liquid atomizing device 100 of an embodiment of this invention. The liquid atomizing device 100 comprises a cylindrical body 101 and a nozzle 110. The cylindrical body 101 comprises an inner cylinder 102 and an outer cylinder 105 concentrically and integrally secured to said inner cylinder 102 at the front end thereof. An annular channel 104 is formed between the inner cylinder 102 and the outer cylinder 105. The inner cylinder 102 has a fitting portion 103 having steps at the rear end thereof. The front end **105*b* of the outer cylinder 105 is projecting ahead by a distance a from the front end 102*b* of the inner cylinder 102. The distance a may be approximately 1.5–3.0 mm. The cylindrical body 101 is concentrically fitted to a rotational shaft, for example, a rotational shaft 1 of a gas turbine (T) at the fitting portion 103. The nozzle 110 is in the shape of a pipe and a liquid passage 110*a* thereof is communicated with the exterior through an injection port 110*b* provided adjacent to the closed end of the nozzle 110. The injection port 110*b* faces to a smooth inner peripheral surface 102*a* of the inner cylinder 102**.

The liquid is injected under an appropriate pressure against the inner peripheral surface **102*a* of the inner cylinder 102 from the nozzle 110 through the injection port 110*b*. Due to the rotation of the inner cylinder 102, a thin layer, or a boundary layer, of a gas moving at a circumferential speed, the same with that of the inner cylinder 102, is formed on the inner peripheral surface 102*a*. The liquid injected through the port 110*b* jumps into the boundary layer, and is pulled by said flowing gas and the rotation of the inner cylinder 102 to rotate in the direction identical with that of the inner peripheral surface 102*a*. Consequently the liquid is pressed against the inner peripheral surface 102*a* by the centrifugal force and spreads over the inner peripheral surface 102*a* forming a thin liquid layer. When the cylindrical body 101 is applied to a gas turbine, the circumferential speed of the inner peripheral surface 102*a*** becomes about 200 m/sec, so that the centrifugal force becomes up to $10^5$ G (G is a gravitational acceleration).

When the rotational speed of the inner cylinder 102 is increased, the liquid layer on the inner peripheral surface **102*a* becomes thinner and is spouted radially outwards from the entire periphery of the front end 102*b* of the inner cylinder 102 in a substantially uniform thin layer or in fine threadlike forms to reach a smooth inner peripheral surface 105*a* of the outer cylinder 105. As a boundary layer is formed also on the inner peripheral surface 105*a* of the outer cylinder 105, the liquid in the form of a thin layer or fine threads reaching said surface 105*a* attaches to the inner peripheral surface 105*a* within said boundary layer. The liquid is pressed against the inner peripheral surface 105*a* by the centrifugal force larger than that exerted on the inner peripheral surface 102*a* of the inner cylinder 102** to form a very thin liquid layer all over the entire peripheral surface 105*a*. This liquid layer is spouted from the entire periphery of the front end 105*b* of the outer cylinder 105 by the centrifugal force larger than that on the inner peripheral surface 102*a* of the inner cylinder 102 to form a spray of finer particles each having a very small diameter.

It is generally known that the most effective method to obtain a spray of particles each having a small diameter is to make the ratio of the surface area of the liquid to the weight thereof as large as possible immediately before the liquid splits into particles. In this embodiment, the liquid layer spreading all over the inner peripheral surfaces 105*a* is extremely thin, so that in the liquid layer formed immediately before it is scattered from the entire periphery of the front end 105*b* of the outer cylinder 105, the ratio of the surface area of the layer to the weight thereof, or the value of the (surface area)/(weight) is very large. Consequently, the liquid scattered from the front end 105*b* of the outer cylinder 105 forms a spray of fine liquid particles each having a very small diameter.

Figure 3:
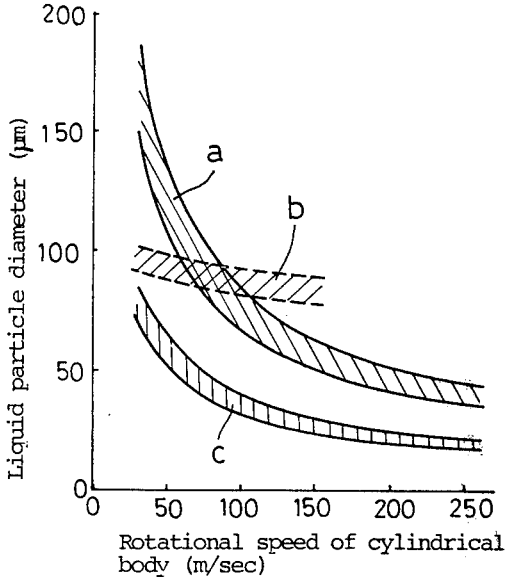
FIG. 3 illustrates characteristic features of a liquid atomizing device of this invention in comparison with those of conventional liquid atomizing devices.

FIG. 3 illustrates characteristic features of the liquid atomizing device 100 of the first embodiment of this invention and of conventional liquid atomizing devices, in which the circumferencial speeds of the cylindrical bodies are shown in the axis of abscissa and diameters of liquid particles in the axis of ordinate. The curve (a) shows results of a first conventional liquid atomizing device, the curve (b) results of a second conventional liquid atomizing device, and the curve (c) results of the liquid atomizing device of this invention. In these experiments, water is used as an experimental liquid and the particle diameter is indicated by the Sauter mean diameter (volume - surface mean diameter). It is known that when the fuel is used as the liquid, the diameter of a particle of the fuel is reduced to 60–70% of that of water.

In the first conventional liquid atomizing device, the diameter of the injection port is in the range of 0.2–2 mm and in the second conventional liquid atomizing device, the diameter of a swirl nozzle is 0.3 mm. As shown in FIG. 3, the liquid atomizing device 100 of this invention may produce finer liquid particles each having a smaller particle size than those of conventional liquid atomizing devices. Especially, in the first conventional liquid atomizing device, how small the diameter of the injection port may be formed, the particle size of liquid particles obtained in said first conventional device can not be made smaller than that obtained in the liquid atomizing device 100 of the first embodiment of this invention.

Figure 4:
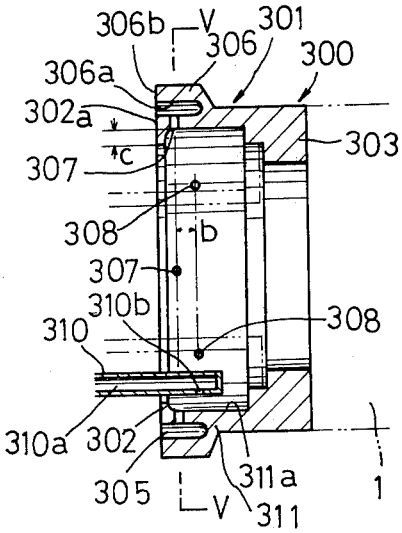
FIG. 4 is a longitudinal cross section of a second embodiment of this invention.
Figure 5:
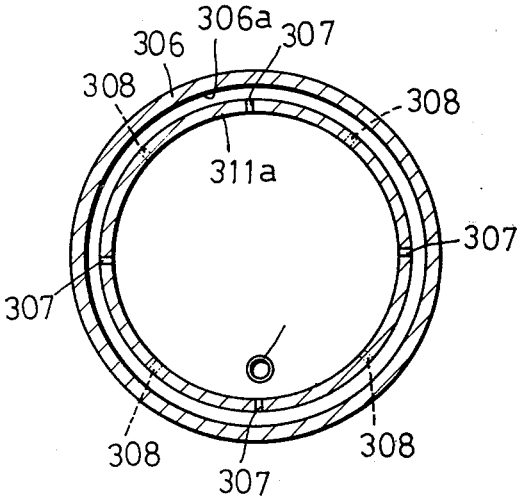
FIG. 5 is a sectional view taken on line V—V in FIG. 4.

FIGS. 4 and 5 show a liquid atomizing device 300 of a second embodiment of this invention. The liquid atomizing device 300 comprises a cylindrical body 301 and a nozzle 310. The cylindrical body 301 comprises an inner cylinder 311 and an outer cylinder 306 concentrically and integrally formed with the inner cylinder 311. An annular channel 305 is formed between the inner cylinder 311 and the outer cylinder 306. The inner cylinder 311 has a stepped end portion 303 and a rim 302 projecting inwards at the front end thereof. The front end 302*a* of the rim 302 and the front end 306*b* of the outer cylinder 306 are positioned in one plane. A plurality of (four in the embodiment of FIGS. 4 and 5) identically spaced apart injection ports 307 are provided in a single row along the circumference of the peripheral wall of the inner cylinder 311 adjacent to the rim 302 and communicating the smooth inner peripheral surface 311*a* of the inner cylinder 311 and the annular channel 305. Further, a plurality of injection ports 308 are provided in a row in the inner cylinder 311 in parallel with but zigzag leaving a space b from the row of the injection ports 307. The injection ports 308 also communicate the inner peripheral surface 311*a* of the inner cylinder 311 and the annular channel 305. The space b may be approximately 1–2 mm. The projecting amount c of the rim 302 from the inner peripheral surface 311*a* may be approximately 0.5–1.5 mm.

The cylindrical body 301 is concentrically secured to a rotational shaft, for example, the rotational shaft 1 of the gas turbine (T) at the stepped end portion 303. The liquid passes through a liquid passage 310*a* of the nozzle 310 and is injected against the inner peripheral surface 311*a* of the inner cylinder 311 under an appropriate pressure through an injection port 310*b* adjacent to the closed end of the nozzle 310. As the inner cylinder 311 is rotating, a boundary layer moving at the speed same with that of the inner cylinder 311 is formed on the inner peripheral surface 311*a* of the inner cylinder 311. When the liquid goes into the boundary layer, it attaches to the inner peripheral surface 311*a* and is pulled by the flowing gas and the rotation of the inner cylinder 311 to rotate at a speed same with that of the inner peripheral surface 311*a*. Accordingly, the liquid is pressed against the inner peripheral surface 311*a* by the large centrifugal force and spreads over the inner peripheral surface 311*a* forming a thin liquid layer in the same way as in the first embodiment. This liquid layer is prevented from flowing out from the front end of the inner cylinder 311 by the rim 302, so that it is injected into the annular channel 305 through each injection port 307, 308 in a fine threadlike flow of particles having a uniform particle size and particle distribution. The threadlike flow enters a boundary layer produced on the smooth inner peripheral surface 306*a* of the outer cylinder 306 and receives the effect of the centrifugal force larger than that exerted on the inner peripheral surface 311*a* of the inner cylinder 311 to form an extremely thin liquid layer. The thin liquid layer adheres to the inner peripheral surface 306*a* and is scattered uniformly and radially from the entire periphery of the front end 306*b* of the outer cylinder 306 due to the large centrifugal force to display an effect substantially the same with that of the first embodiment.

Figure 6:
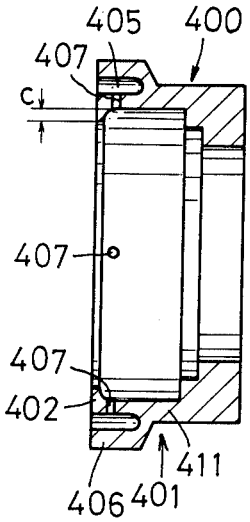
FIGS. 6, 7 and 8 are each a longitudinal sectional view of a third, a fourth and a fifth embodiment of this invention, respectively.

FIG. 6 shows a liquid atomizing device 400 of a third embodiment of this invention. In this embodiment a group of injection ports 308 are removed from the liquid atomizing device 300 of the second embodiment shown in FIGS. 4 and 5 and the liquid atomizing effect thereof is slightly inferior to that of the device 300 of the second embodiment. A cylindrical body 401, a rim 402, an annular channel 405, an outer cylinder 406, injection ports 407 and an inner cylinder 411 are provided in this liquid atomizing device 400.

Figure 7:
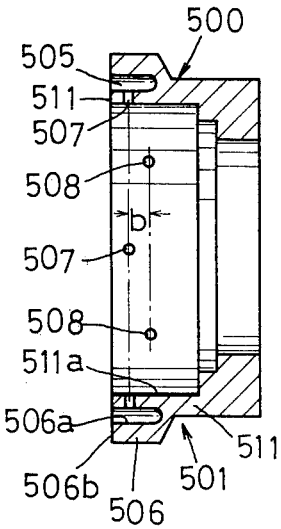

FIG. 7 shows a liquid atomizing device 500 of a fourth embodiment of this invention. In this liquid atomizing device 500 the rim 302 is removed from the liquid atomizing device 300 of the second embodiment. In this fourth embodiment, a liquid injected through a nozzle not shown adheres to an inner peripheral surface 511*a* of an inner cylinder 511 to form a thin liquid layer. A part of the liquid layer is scattered from a front end 511*b* of the inner cylinder 511 and the other part of the liquid layer is injected through the injection ports 507 and 508 and is formed into an extremely thin liquid layer by adhering to an inner peripheral surface 506*a* of the outer cylinder 506 to be uniformly scattered from a front end 506*b* of the outer cylinder 506. A cylindrical body 501 and an annular channel 505 are provided in the same manner as in the embodiments above described.

Figure 8:
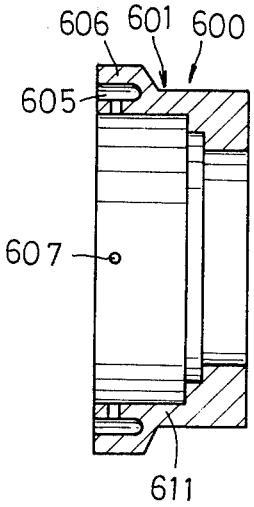

FIG. 8 shows a liquid atomizing device 600 of a fifth embodiment of this invention. In this liquid atomizing device 600, injection ports 508 are removed from the liquid atomizing device 500 of the fourth embodiment shown in FIG. 7 and its liquid atomizing effects are a little inferior to that of the device 500. A cylindrical body 601, an annular channel 605, an outer cylinder 606, injection ports 607 and an inner cylinder 611 are provided in the same way as in the other embodiment.

Figure 10:
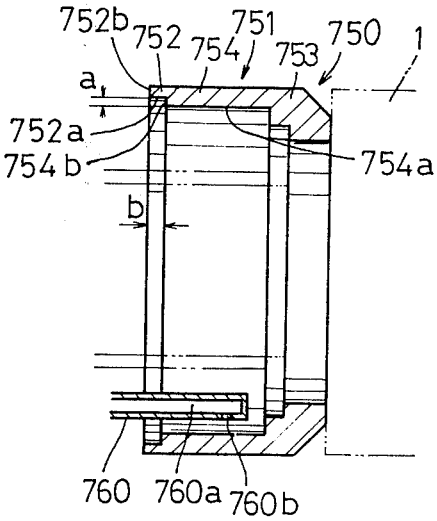
FIG. 10 is a longitudinal sectional view of a sixth embodiment of this invention.

FIG. 10 shows a liquid atomizing device 750 of a sixth embodiment of this invention. The liquid atomizing device 750 comprises a cylindrical body 751 and a nozzle 760. The cylindrical body 751 comprises an inner cylindrical portion 754 having an inner peripheral surface 754*a* and an outer cylindrical portion 752 having an inner peripheral surface 752*a*. The outer cylindrical portion 752 is longitudinally and outwardly projecting from the front end of the inner cylindrical portion 754. The inner peripheral surface 752*a* of the outer cylindrical portion 752 is coaxial with the inner peripheral surface 754*a* of the inner cylindrical portion 754 and has a radius larger than that of the inner peripheral surface 754*a* by a distance a. In this sixth embodiment, the diameter of the outer periphery of the inner cylindrical portion 754 is identical with that of the outer cylindrical portion 752. The inner cylindrical portion 754 has a stepped end portion 753 connectable to a rotational shaft. The inner peripheral surfaces 752*a* and 754*a* both have a smooth finish thereon. The distance a may be 0.5–0.2 mm. The longitudinally and outwardly projecting length of the outer cylindrical portion 752 from the inner cylindrical portion 754 may be 1–3 mm. The cylindrical body 751 is secured to a rotational shaft, for example, the rotational shaft 1 of the gas turbine (T) at the stepped end portion 753. The nozzle 760 is, similarly to the nozzle 110, tube-shaped and its liquid passage 760*a* is communicating with the exterior through an injection port 760*b* adjacent to a closed end of the liquid passage 760*a*. The injection port 760*b* is opposite to the inner peripheral surface 754*a* of the inner cylindrical portion 754.

A liquid is injected through the injection port 760*b* of the nozzle 760 against the inner peripheral surface 754*a* of the inner cylindrical portion 754 under an appropriate pressure. The injected liquid adheres to the inner peripheral surface 754*a* of the outer cylindrical portion rotating at a high speed and is pulled to rotate therewith to form a thin liquid layer in the same way as in the first embodiment. The thin liquid layer is scattered from the front end 754*b* of the inner cylindrical portion 754 in the form of a very thin layer or fine threads and attaches to the inner peripheral surface 752*a* of the outer cylindrical portion 752. The inner peripheral surface 752*a* of the outer cylindrical portion 752 has a radius larger than that of the inner peripheral surface 754*a* of the inner cylindrical portion 754 by a distance a, so that the centrifugal force exerted on the inner peripheral surface 752*a* is larger than that on the inner peripheral surface 754*a*, which results in making a thinner liquid layer. Accordingly, the liquid scattered from the front end 752*b* of the outer cylindrical portion 752 is made in a spray of finer liquid particles each having very small particle diameter.

Figure 1:
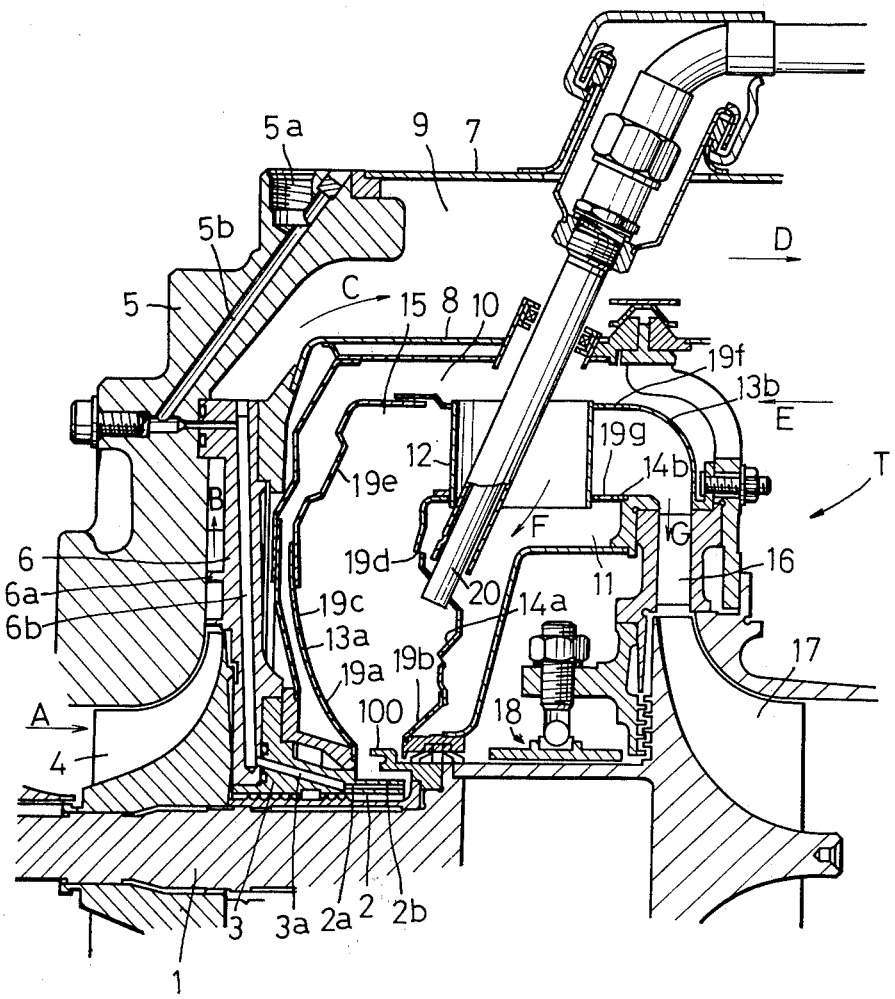
FIG. 1 is a partial longitudinal sectional view of a gas turbine, in which an example of an embodiment of this invention is employed.

Operation of the liquid atomizing device 100 of the first embodiment as well as the structure and operation of a gas turbine (T) of FIG. 1 will be described supposing that the device 100 is associated with the gas turbine (T). The cylindrical body 101 of the liquid atomizing device 100 is, through the stepped end portion 103, secured to a rotational shaft 1 of the gas turbine (T) to rotate at a high speed together therewith. The rotational shaft 1 is rotated by a turbine rotor 17. In accordance with the rotation of the rotational shaft 1 a compressor rotor 4 rotates and the air is sucked in the compressor rotor 4 following an arrow A. A velocity energy is given to the air by said compressor rotor 4 and said air flows into vanes 6*a* of a diffuser 6 following an arrow B, in which the speed of the air is reduced and the pressure thereof is increased. From the diffuser 6 the air is further forwarded into an annular air passage 9 formed between an outer housing 7 and an inner housing 8 following an arrow C. The air is introduced into a heat exchanger not shown from the air passage 9 following an arrow D to be heated and further introduced into an air chamber 10 following an arrow E. A part of the heated air is introduced into an air chamber 11 following an arrow F, too, through an air pipe 12.

Liquid fuel fed from a fuel supplying port 5*a* provided in a front housing 5 is supplied into a fuel passage 110*a* of a fuel nozzle 110 through a fuel passage 5*b* in the front housing 5, 6*b* in the diffuser 6 and 3*a* in a retainer 3. The supplied fuel is injected through a fuel injection port 110*b* against the inner peripheral surface 102*a* of the inner cylinder 102 of the liquid atomizing device 100. As mentioned above, said liquid fuel arrives at the inner peripheral surface 105*a* of the outer cylinder 105 from the front end 102*b* of the inner cylinder 102 and forms a very thin liquid layer over the inner peripheral surface 105*a* due to the centrifugal force exerted on the inner peripheral surface 105*a* of the outer cylinder 105 and larger than that on the inner peripheral surface 102*a* of the inner cylinder 102. The thin liquid fuel layer is uniformly scattered from the front end 105*b* of the outer cylinder 105 in the shape of a spray of fine liquid particles each having a very small particle diameter and supplied to a combustion chamber 15. This fuel is mixed with the air introduced into the combustion chamber 15 through air ports 19*a*, 19*b*, 19*c*, 19*d* and 19*e* provided in casings 13*a* and 14*a* of the gas turbine (T) and lighted by an ignition plug 20 to burn continuously within the combustion chamber 15. The combustion gas is mixed with the air introduced through air ports 19*f* and 19*g* provided in casings 13*b* and 14*b* and the temperature of the combustion gas is lowered to an appropriate one. The combustion gas mixed with the air is further introduced into a turbine nozzle 16 following an arrow G and blows against a turbine rotor 17 to rotate it. An air bearing 18 supports the rotational shaft 1 rotatably at a high speed together with another bearing not shown.

Figure 9:
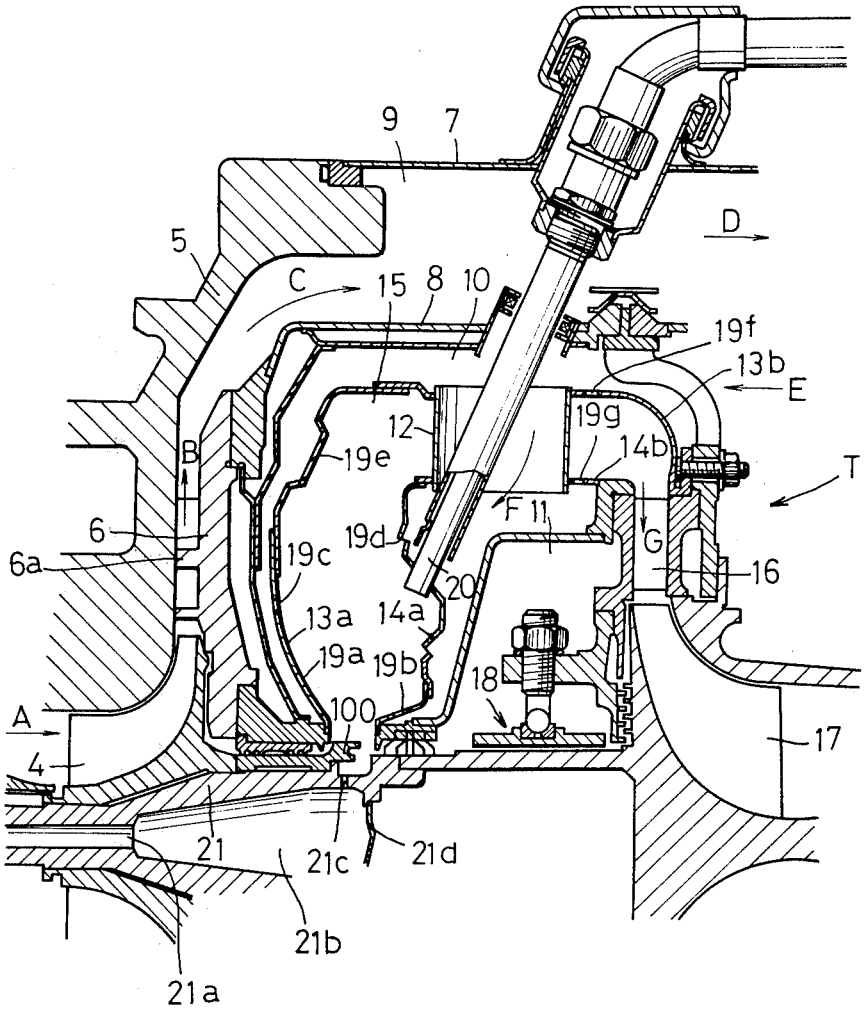
FIG. 9 is a partial sectional view of a gas turbine, in which another example of an embodiment of this invention is employed.

FIG. 9 shows another example of employment of the liquid atomizing device 100 of this invention to a gas turbine (T'). In this gas turbine (T'), the fuel is introduced through a port 21*a* at the front end of a rotational shaft 21 into a hollow space 21*b* having an end plate 21*d* and provided in the rotational shaft 21 and injected through an injection port 21*c* into the interior of the inner cylinder 102 of the liquid atomizing device 100. In this example the injection port 21*c* rotates at a rotational speed identical with that of the inner cylinder 102. In this point this second example is different from the first example shown in FIG. 1, in which the fuel injection port 110*b* is fixed, but the fuel atomizing operation of this example is same with that of the first example.

According to this invention, at least the major part of the liquid injected through the nozzle against the inner peripheral surface of the inner cylinder is uniformly spread over that inner peripheral surface due to the centrifugal force produced by the rotation of the inner cylinder. It is then transfered onto the inner peripheral surface of the outer cylinder to form a very thin liquid layer over the inner peripheral surface of the outer cylinder due to the centrifugal force larger than that on the inner surface of the inner cylinder. The liquid is finally sprayed uniformly from the edge of the outer cylinder along the entire periphery thereof to form very fine liquid particles. When the liquid atomizing device of this invention is employed in a gas turbine, therefore, superior evaporation of the fuel and uniform mixture of the evaporated fuel and air are obtained in the combustion chamber of the gas turbine, so that the temperature distribution in the combustion chamber is uniformalized and thermal efficiency of the gas turbine is improved.

What is claimed is:

1. A liquid atomizing device comprising a sleeve-shaped body provided with an inner cylinder having a cylindrical inner peripheral surface and an outer cylinder fitted to the front end of the inner cylinder and having a cylindrical inner peripheral surface concentric with said inner peripheral surface of the inner cylinder and a nozzle injecting a liquid against the inner peripheral surface of the inner cylinder, in which said sleeve-shaped body may be secured to a rotational shaft at the rear end thereof concentrically therewith, both of said inner peripheral surfaces of the inner and outer cylinders having a smooth finish thereon and the inner peripheral surface of the outer cylinder having a diameter larger than that of the inner cylinder, and an annular channel opening forward is provided between front ends of the inner and the outer cylinders.

2. A liquid atomizing device as set forth in claim 1, wherein the front ends of the inner and the outer cylinders are positioned in a plane and a plurality of injection ports at least in a single row are provided along the circumference of the inner peripheral surface of the inner cylinder and communicating the interior of the inner cylinder with said annular channel.

3. A liquid atomizing device as set forth in claim 2, wherein said injection ports are positioned zigzag.

4. A liquid atomizing device as set forth in claim 2, wherein a rim projecting radially inwards is provided at the front end of the inner cylinder.

5. A liquid atomizing device as set forth in claim 3, wherein a rim projecting radially inwards is provided at the front end of the inner cylinder.

* * * * *